US005803878A

United States Patent [19]

Chiang

[11] Patent Number: 5,803,878

[45] Date of Patent: Sep. 8, 1998

[54] EXERCISING MACHINE

[76] Inventor: Yao-Chin Chiang, No. 122, Shui Nan Rd., Pei Tun Dist., Taichung, Taiwan

[21] Appl. No.: 906,639

[22] Filed: Aug. 7, 1997

[51] Int. Cl.[6] ..... A63B 21/068

[52] U.S. Cl. ..... 482/96; 482/136; 482/137; 482/138

[58] Field of Search ..... 482/72, 95, 96, 482/100, 136–138

[56] References Cited

U.S. PATENT DOCUMENTS

| | | | |
|---|---|---|---|
| 5,492,518 | 2/1996 | Measom | 482/96 |
| 5,531,658 | 7/1996 | L.S.C. | 482/96 X |
| 5,549,529 | 8/1996 | Rasmussen | 482/96 |

*Primary Examiner*—Richard J. Apley
*Assistant Examiner*—John Mulcahy
*Attorney, Agent, or Firm*—Welsh & Katz, Ltd.

[57] ABSTRACT

An exercising machine includes a sliding sleeve slidably mounted on an upright post fixedly mounted on one end portion of a base, at least one supporting strut mounted on a mediate portion of the base, a seat fixedly mounted on an upper end portion of the sliding sleeve, and an arm training mechanism. The arm training mechanism includes a connecting rod rotatably mounted on the supporting strut, two handles each having a lower end portion detachably attached to one end portion of the connecting rod for rotating the connecting rod along a horizontal axis, a drive lever having a first end fixedly mounted on a mediate portion of the connecting rod, an intermediate lever having a first end pivotally connected with a second end of the drive lever, and a driven lever having a first end pivotally connected with a second end of the intermediate lever and a second end fixedly mounted on a lower end portion of the sliding sleeve.

6 Claims, 8 Drawing Sheets

EXERCISING MACHINE

FIELD OF THE INVENTION

The present invention relates to an exercising machine.

BACKGROUND OF THE INVENTION

Sometimes, our exercise activities are restricted to being performed indoors due to the heavy traffic or bad weather, therefore, it is necessary to provide an exerciser which can be employed indoors for exercising purposes.

The present invention has arisen to solve the above-mentioned problem.

SUMMARY OF THE INVENTION

In accordance with one aspect of the present invention, there is provided an exercising machine comprising a base, an upright post fixedly mounted on one distal end portion of the base, a sliding sleeve slidably mounted on the upright post, a seat fixedly mounted on an upper end portion of the sliding sleeve, at least one supporting strut vertically mounted on a mediate portion of the base, and an arm training mechanism.

The arm training mechanism includes a connecting rod rotatably mounted on the supporting strut and having two end portions, two handles each having a lower end portion detachably attached to a corresponding one of the two end portions of the connecting rod for rotating the connecting rod along a horizontal axis thereof, a drive lever having a first end fixedly mounted on a mediate portion of the connecting rod to rotate therewith, an intermediate lever having a first end pivotally connected with a second end of the drive lever, and a driven lever having a first end pivotally connected with a second end of the intermediate lever and a second end fixedly mounted on a lower end portion of the sliding sleeve.

Further features of the present invention will become apparent from a careful reading of the detailed description with appropriate reference to the accompanying drawings.

DETAILED DESCRIPTION OF THE PREFERRED EMBODIMENTS

Figure 1:
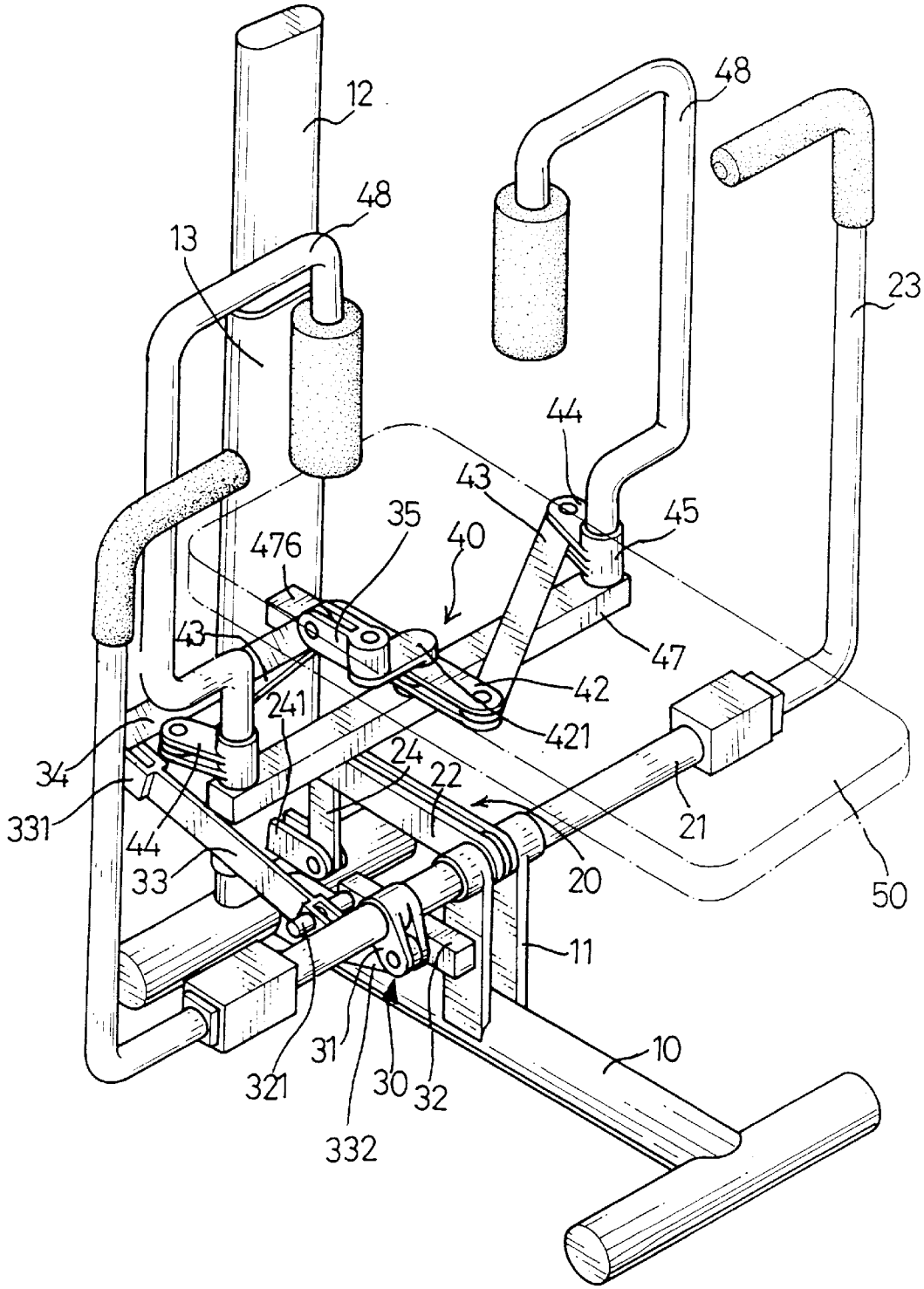
FIG. 1 is a perspective view of an exercising machine in accordance with the present invention.
Figure 2:
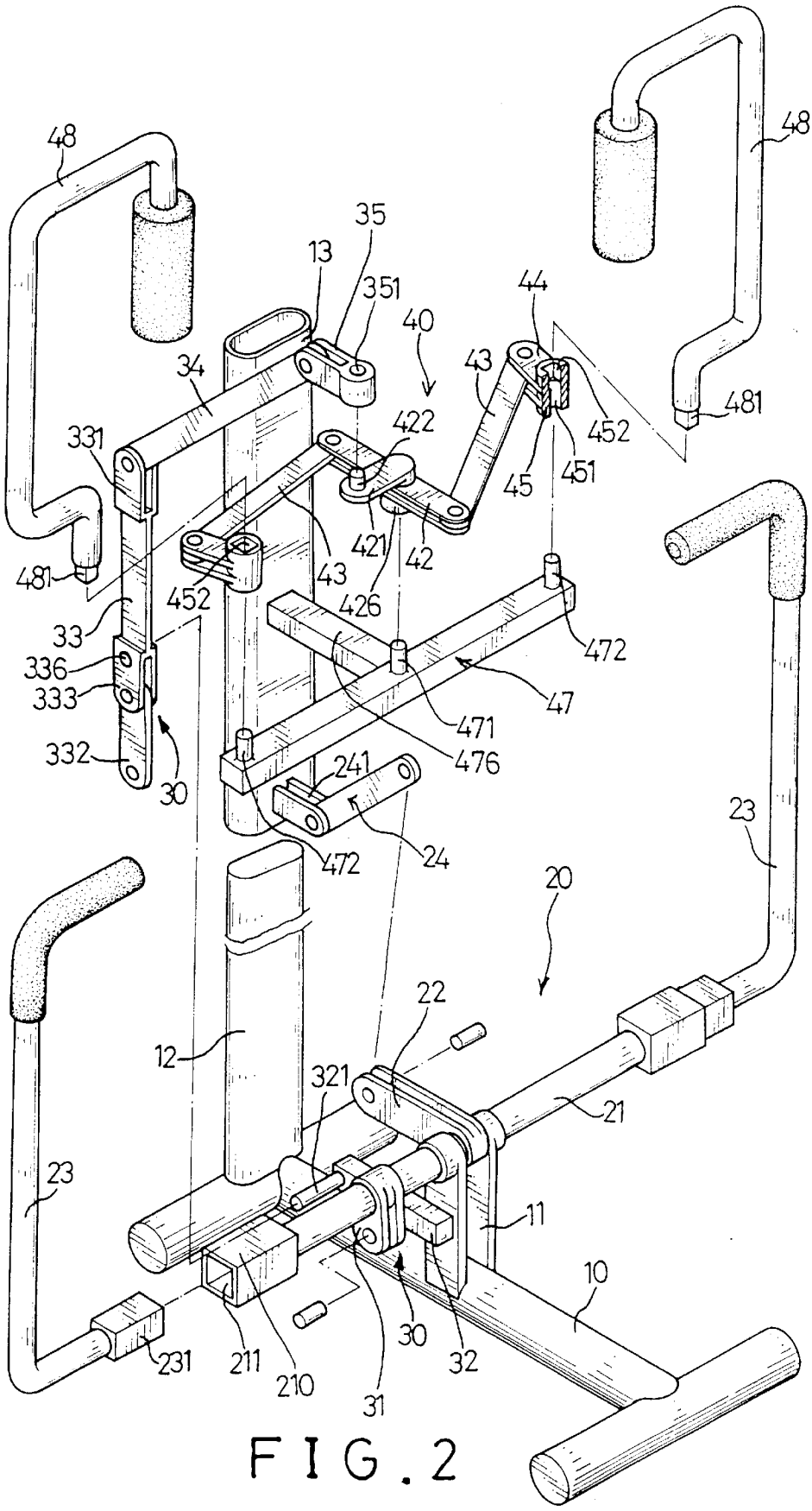
FIG. 2 is an exploded view of the exercising machine shown in FIG. 1.
Figure 3:
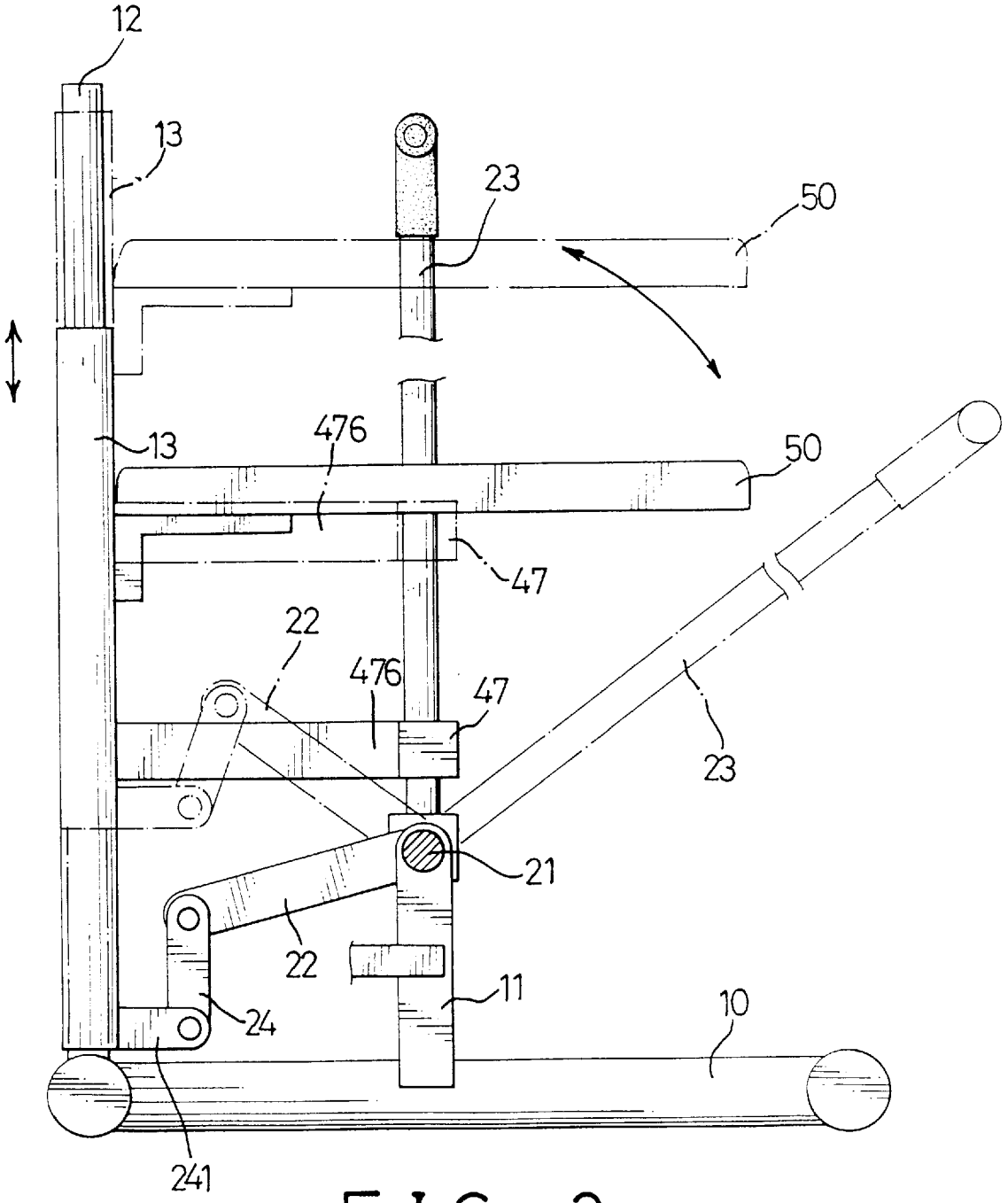
FIG. 3 is a side partially cross-sectional operational view of FIG. 1.

Referring to the drawings, and initially to FIGS. 1–3, an exercising machine according to the present invention comprises a substantially I-shaped base 10 disposed in a horizontal manner, and an oblong upright post 12 fixedly mounted on one distal end portion of the base 10. A sliding sleeve 13 is slidably mounted on the upright post 12, and a seat 50 is fixedly mounted on an upper end portion of the sliding sleeve 13. Two juxtaposed supporting struts 11 are vertically mounted on a mediate portion of the base 10.

An arm training mechanism 20 comprises a connecting rod 21 rotatably mounted on the juxtaposed supporting struts 11 and including two end portions. Two substantially U-shaped handles 23 each include a lower bent portion detachably attached to a corresponding one of the two end portions of the connecting rod 21 for rotating the connecting rod 21.

Each of the two end portions of the connecting rod 21 is formed with a tetragonal socket 210 defining a tetragonal recess 211 therein, and the lower bent portion of each of the two handles 23 is formed with a tetragonal plug 231 detachably received in the respective recess 211 of the connecting rod 21.

A drive lever 22 includes a first end fixedly mounted on a mediate portion of the connecting rod 21 to rotate therewith. An intermediate lever 24 includes a first end pivotally connected with a second end of the drive lever 22. A driven lever 241 includes a first end pivotally connected with a second end of the intermediate lever 24 and a second end fixedly mounted on a lower end portion of the sliding sleeve 13.

In operation, referring now to FIG. 3 with reference to FIGS. 1 and 2, each of the two handles 23 can be rotated by a user sitting on the seat 50 to be moved to a position as shown in phantom lines in FIG. 3, thereby rotating the connecting rod 21 which in turn displaces the drive lever 22, the intermediate lever 24 and the driven lever 241 to a position as shown in phantom lines in FIG. 3 such that the sliding sleeve 13 together with the seat 50 can be lifted by means of overcoming the user's own weight, thereby achieving the purpose for training and exercising the user's arm muscles.

Referring now to FIGS. 4–8 with reference to FIG. 2, in accordance with another embodiment of the present invention, each of the two handles 23 is removed.

The exercising machine further comprises a side expanding mechanism 40 including an extension beam 476 extending from a mediate portion of the sliding sleeve 13 toward the supporting struts 11, and a supporting beam 47 having a mediate portion fixedly mounted on the extension beam 476 and having two end portions.

Two rotary sockets 45 are each rotatably mounted on a corresponding one of the two end portions of the supporting beam 47. Two secondary handles 48 each include a lower end portion detachably mounted on a corresponding one of the two rotary sockets 45 for rotating the rotary socket 45 along a vertical axis thereof.

Two short arms 44 each extend from a corresponding one of the two rotary sockets 45 to rotate therewith. Two intermediate arms 43 each include a first end pivotally connected with a corresponding one of the two short arms 44. A driven arm 42 is pivotally mounted on a mediate portion of the supporting beam 47 along a vertical axis and includes two end portions each pivotally connected with a second end of a corresponding one of the two intermediate arms 43.

Each of the two end portions of the supporting beam 47 includes a stub 472 extending upwardly, and each of the two rotary sockets 45 has a lower portion defining a circular recess 451 for receiving the stub 472 such that each of the rotary sockets 45 can be rotated about the stub 472.

A pivot stub 471 is fixedly mounted on the mediate portion of the supporting beam 47, and a pivot cylinder 426 is fixedly mounted on an underside of a mediate portion of the driven arm 42 for receiving the pivot stub 471 such that the driven arm 42 can be pivoted relative to the pivot stub 471.

Each of the two rotary sockets 45 has an upper portion defining a tetragonal recess 452 therein, and the lower end portion of each of the two secondary handles 48 is formed with a tetragonal plug 481 detachably received in the tetragonal recess 452 of the rotary socket 45 such that each of the rotary sockets 45 can be rotated by the secondary handle 48.

The side expanding mechanism 40 further comprises a knob 421 having a first end portion fixedly mounted on a top face of the mediate portion of the driven arm 42 to pivot therewith, and a vertical axle 422 fixedly mounted on a second end portion of the knob 421.

The exercising machine further comprises a link mechanism 30 including a pivot base 35 including a first end portion defining a vertical hole 351 for rotatably receiving the vertical axle 422 therein.

A first brace 34 includes a first end portion pivotally connected with a second end portion of the pivot base 35 along a horizontal axis. A second brace 33 includes a first end portion 331 pivotally connected with a second end portion of the first brace 34, a second end portion 333, and a mediate portion located adjacent to the second end portion 333 and transversely defining a bore 336 therein. A third brace 332 includes a first end portion pivotally connected with the second end portion 333 of the second brace 33.

A suspension base 31 includes an upper end portion fixedly mounted on the connecting rod 21 and a lower end portion pivotally connected with a second end portion of the third brace 332.

A connecting beam 32 has a first end portion fixedly mounted on one of the supporting struts 11, and a pivot axle 321 horizontally extends from a second end portion of the connecting beam 32 and extends through the bore 336 of the mediate portion of the second brace 33 such that the second brace 33 can be pivoted about the pivot axle 321.

Figure 4:
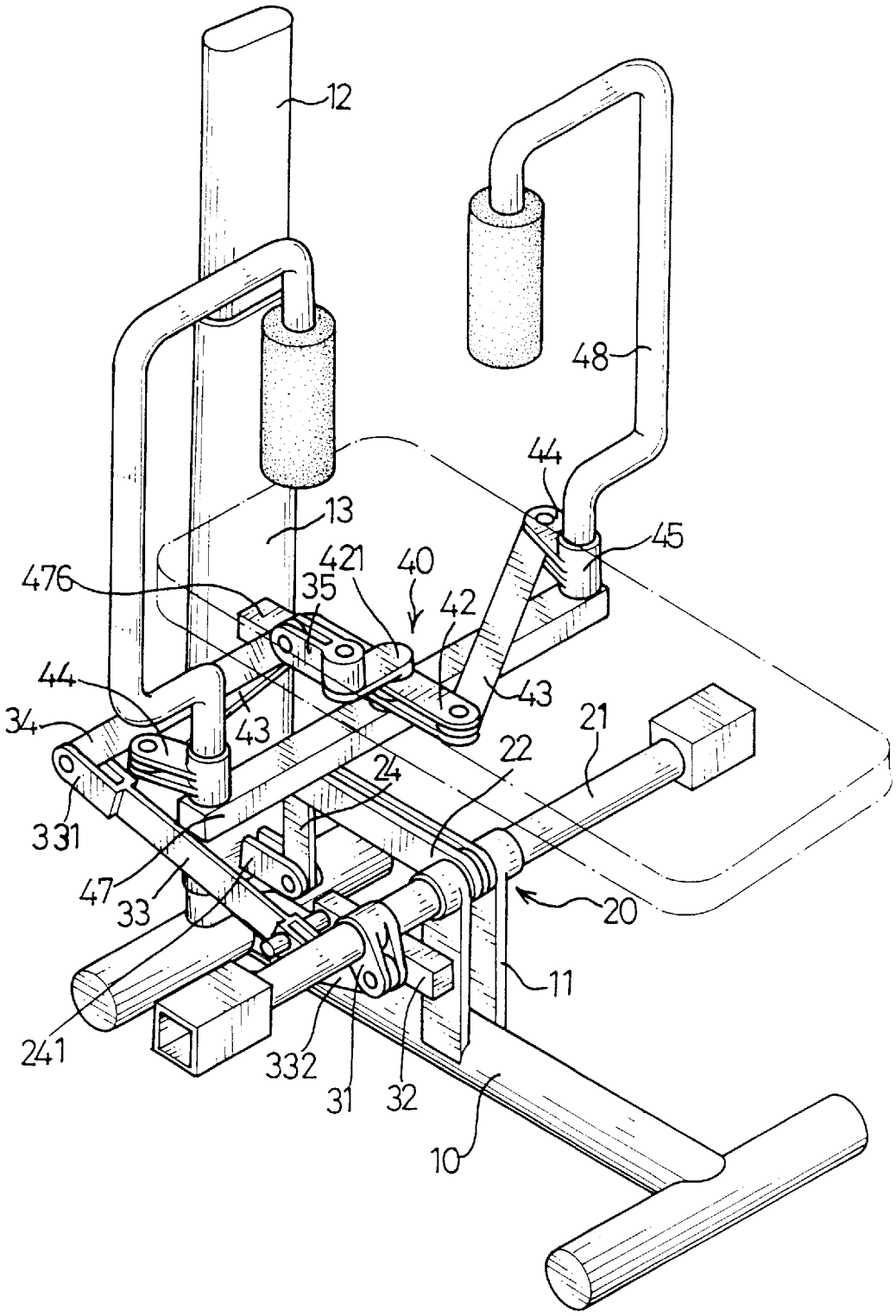
FIG. 4 is a perspective view showing an embodiment of the exercising machine shown in FIG. 1.
Figure 5:
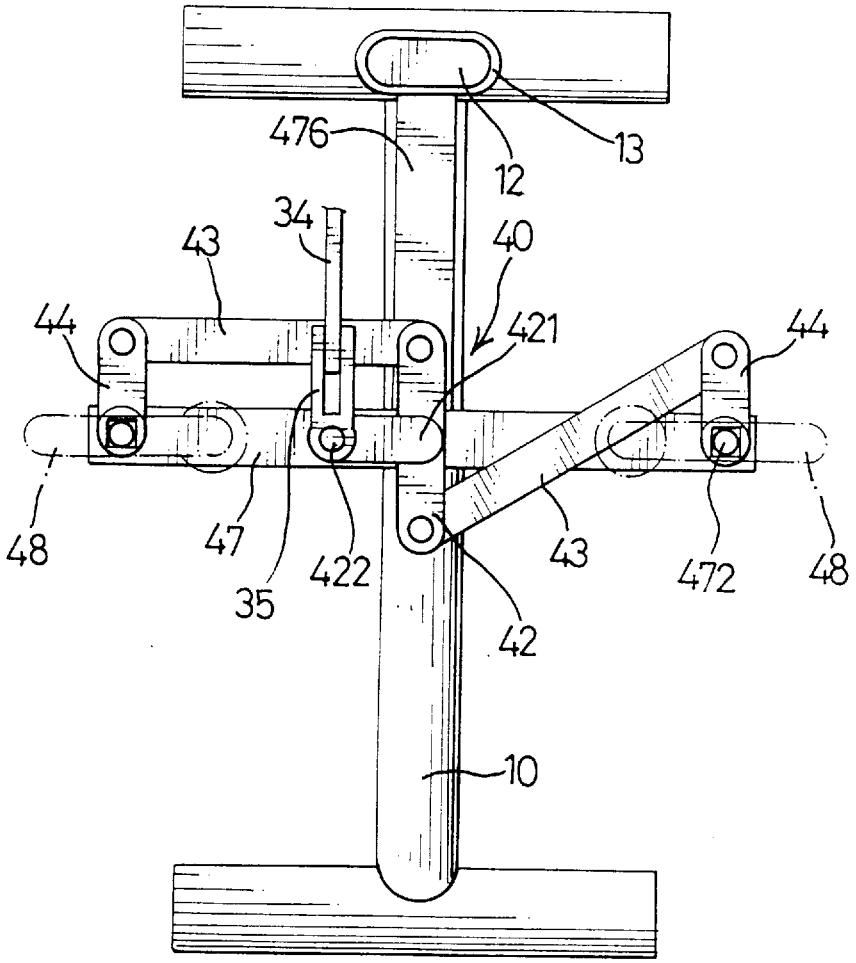
FIG. 5 is a top plan view of the exercising machine shown in FIG. 4.
Figure 6:
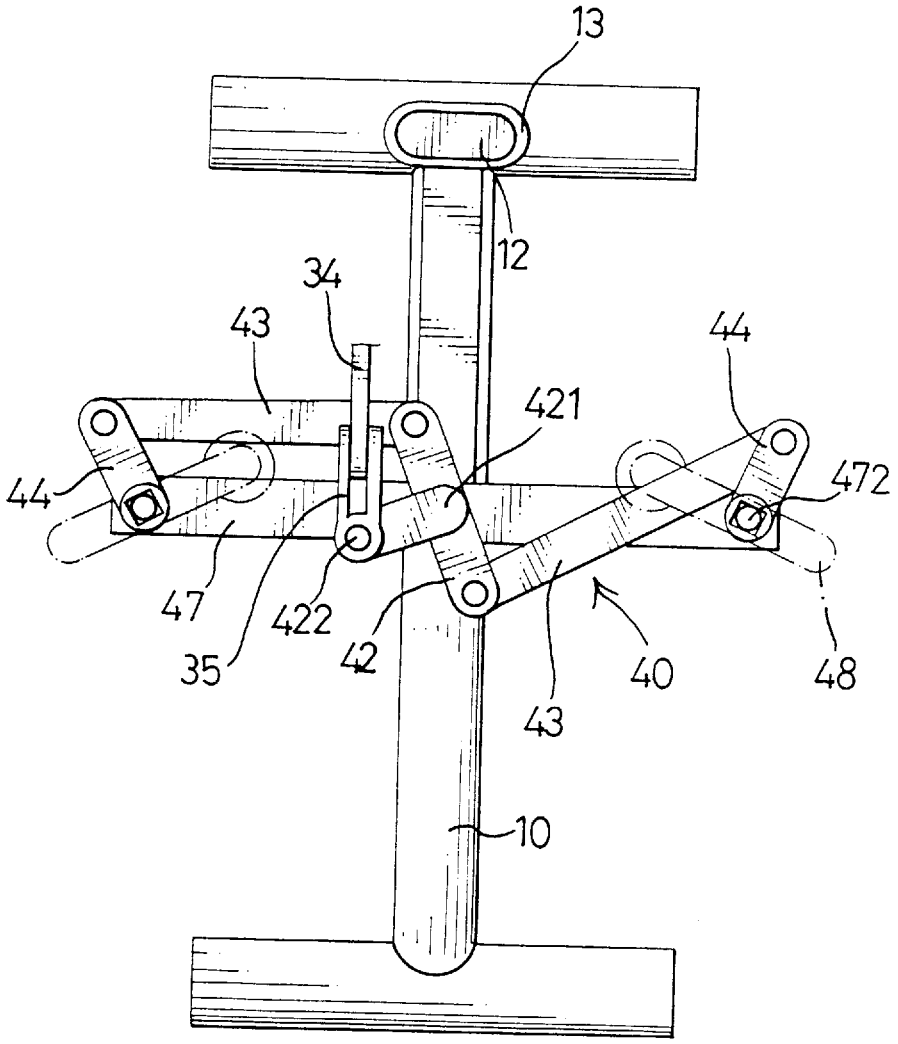
FIG. 6 is an operational view of FIG. 5.
Figure 7:
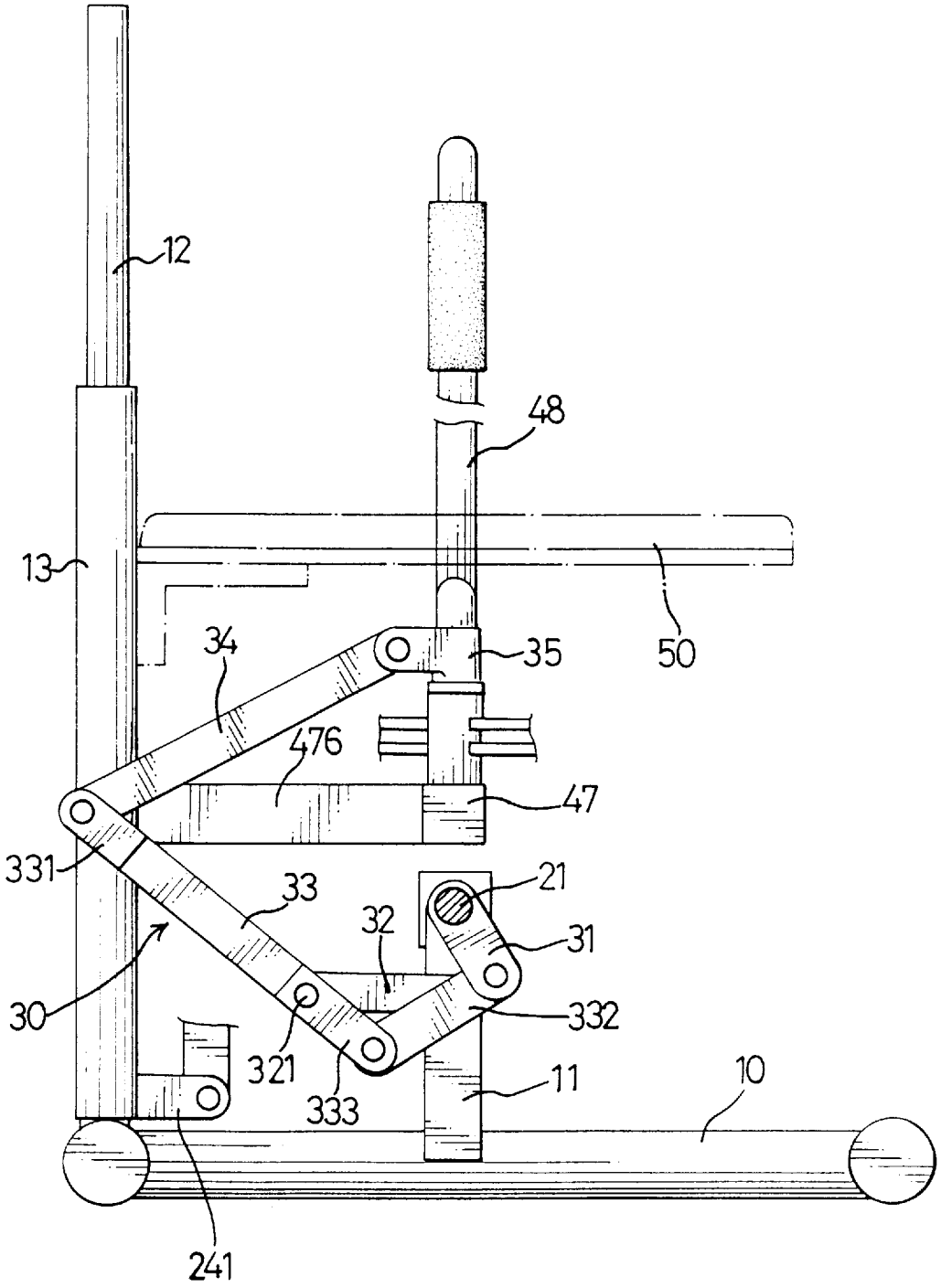
FIG. 7 is a side view of FIG. 4.
Figure 8:
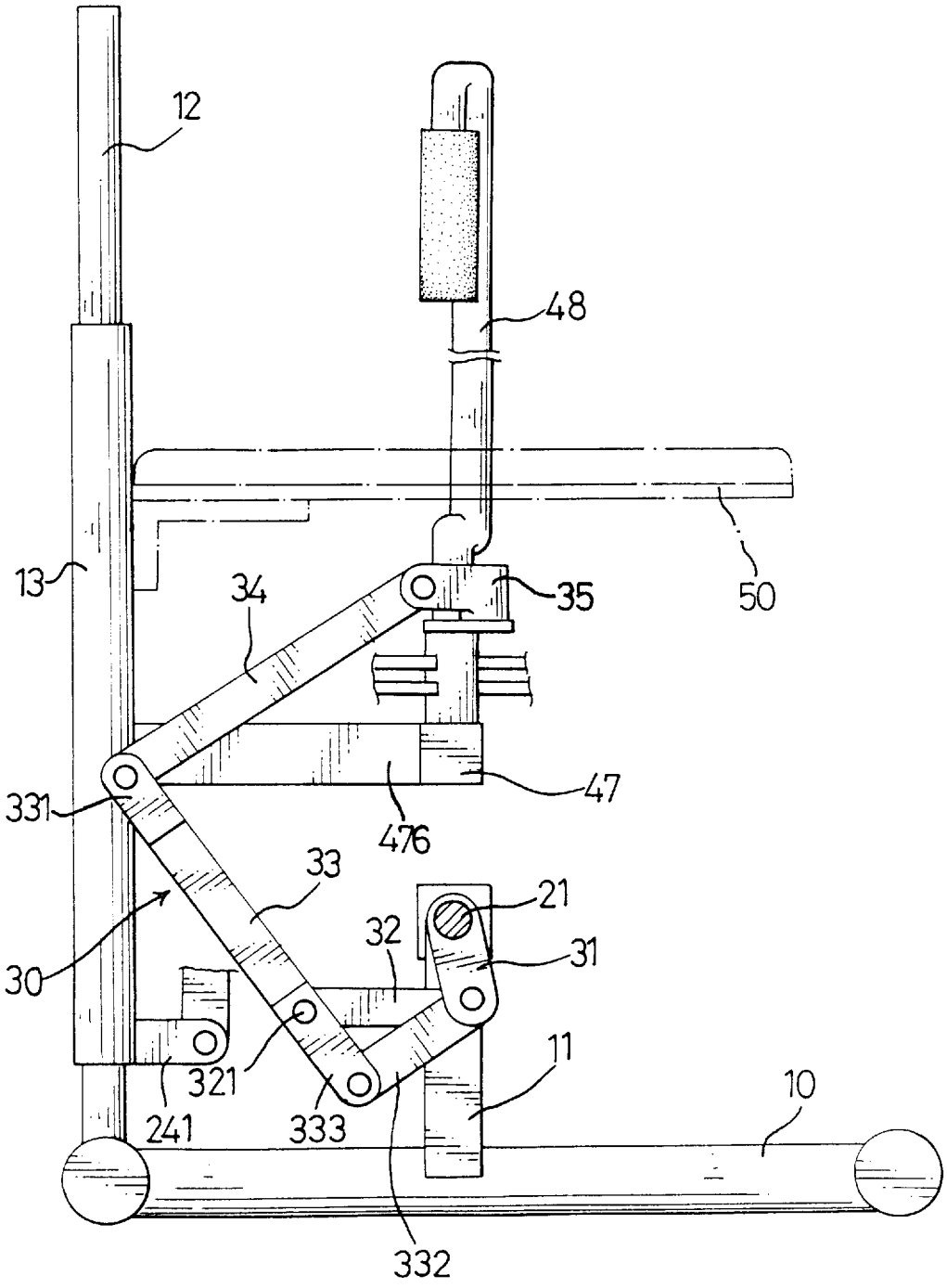
FIG. 8 is an operational view of FIG. 7.

In operation, referring to FIGS. 5–8 with reference to FIGS. 2 and 4, each of the two secondary handles 48 can be rotated by the user to be moved from a first position as shown in phantom lines in FIG. 5 to a second position as shown in phantom lines in FIG. 6, thereby in turn pivoting each of the two short arms 44, each of the two intermediate arms 43 and the driven arm 42 such that the knob 421 can be rotated by the driven arm 42, thereby displacing the pivot base 35 from a first position as shown in FIGS. 5 and 7 to a second position as shown in FIGS. 6 and 8.

In such a situation, when the pivot base 35 is moved rightward from the first position as shown in FIG. 7 to the second position as shown in FIG. 8, the first brace 34 can be moved by the pivot base 35, thereby driving the second brace 33 to pivot about the pivot axle 321.

At the same time, the third brace 332 can be pivoted by the second brace to move the suspension base 31 from a first position as shown in FIG. 7 to a second position as shown in FIG. 8, thereby rotating the connecting rod 21 which in turn displaces the drive lever 22, the intermediate lever 24 and the driven lever 241 to a position as shown in phantom lines in FIG. 3 such that the sliding sleeve 13 together with the seat 50 can also be lifted by means of overcoming the user's own weight, thereby achieving the purpose for exercising the user's chest muscles.

It should be clear to those skilled in the art that further embodiments may be made without departing from the scope and spirit of the present invention.

What is claimed is:

1. An exercising machine comprising:

a base (10);

an upright post (12) fixedly mounted on one distal end portion of said base (10);

a sliding sleeve (13) slidably mounted on said upright post (12);

a seat (50) fixedly mounted on an upper end portion of said sliding sleeve (13);

at least one supporting strut (11) vertically mounted on a mediate portion of said base (10); and an arm training mechanism (20) comprising:

a connecting rod (21) rotatably mounted on said supporting strut (11) and including two end portions;

two handles (23) each including a lower end portion detachably attached to a corresponding one of said two end portions of said connecting rod (21) for rotating said connecting rod (21) along a horizontal axis thereof;

a drive lever (22) having a first end fixedly mounted on a mediate portion of said connecting rod (21) to rotate therewith;

an intermediate lever (24) having a first end pivotally connected with a second end of said drive lever (22); and a driven lever (241) including a first end pivotally connected with a second end of said intermediate lever (24) and a second end fixedly mounted on a lower end portion of said sliding sleeve (13).

2. The exercising machine in accordance with claim 1, wherein each of said two end portions of said connecting rod (21) is formed with a socket (210) defining a tetragonal recess (211) therein, and said lower end portion of each of said two handles (23) is formed with a tetragonal plug (231) detachably received in said recess (211) of said connecting rod (21).

3. The exercising machine in accordance with claim 1, further comprising a side expanding mechanism (40) which includes:

an extension beam (476) extending from a mediate portion of said sliding sleeve (13) toward said supporting strut (11);

a supporting beam (47) including a mediate portion fixedly connected with said extension beam (476) and two end portions;

two rotary sockets (45) each rotatably mounted on a corresponding one of said two end portions of said supporting beam (47);

two secondary handles (48) each including a lower end portion detachably mounted on a corresponding one of said two rotary sockets (45) for rotating said rotary socket (45) along a vertical axis thereof;

two short arms (44) each horizontally extending from a corresponding one of said two rotary sockets (45) to rotate therewith;

two intermediate arms (43) each having a first end pivotally connected with a corresponding one of said two short arms (44); and a driven arm (42) pivotally mounted on a mediate portion of said supporting beam (47) along a vertical axis and including two end portions each pivotally connected with a second end of a corresponding one of said two intermediate arms (43).

4. The exercising machine in accordance with claim 3, wherein each of said two end portions of said supporting beam (47) includes a stub (472) extending upwardly, and each of said two rotary sockets (45) has a lower portion defining a circular recess (451) for receiving said stub (472).

5. The exercising machine in accordance with claim 3, wherein each of said two rotary sockets (45) has an upper portion defining a tetragonal recess (452) therein, and said lower end portion of each of said two secondary handles (48) is formed with a tetragonal plug (481) detachably received in said tetragonal recess (452) of said rotary socket (45).

6. The exercising machine in accordance with claim 3, wherein said side expanding mechanism (40) further comprises a knob (421) having a first end portion fixedly mounted on a mediate portion of said driven arm (42) to pivot therewith, and a vertical axle (422) fixedly mounted on a second end portion of said knob (421), and said exercising machine further comprises a link mechanism (30) includes:

a pivot base (35) including a first end portion defining a hole (351) for rotatably receiving said vertical axle (422) therein;

a first brace (34) including a first end portion pivotally connected with a second end portion of said pivot base (35) along a horizontal axis;

a second brace (33) including a first end portion (331) pivotally connected with a second end portion of said first brace (34), a mediate portion transversely defining a bore (336), and a second end portion (333);

a third brace (332) including a first end portion pivotally connected with said second end portion (333) of said second brace (33);

a suspension base (31) including an upper end portion fixedly mounted on said connecting rod (21) and a lower end portion pivotally connected with a second end portion of said third brace (332); and a connecting beam (32) having a first end portion fixedly mounted on said supporting strut (11), and a pivot axle (321) horizontally extending from a second end portion of said connecting beam (32) and extending through said bore (336) of said second brace (33).

* * * * *